United States Patent [19]

Favrel et al.

[11] Patent Number: 4,573,286

[45] Date of Patent: Mar. 4, 1986

[54] DEVICE FOR SUSPENDING AND GUIDING A MOVABLE PANEL, IN PARTICULAR FOR AN OBLIQUE-DISPLACEMENT SLIDING DOOR

[75] Inventors: Michel Favrel, Le Perreux; Jean-Francois Penanhoat, Herblay, both of France

[73] Assignee: Faiveley Entreprises, Saint-Ouen, France

[21] Appl. No.: 678,502

[22] Filed: Dec. 5, 1984

[30] Foreign Application Priority Data

Jan. 4, 1984 [FR] France ..... 8400062

[51] Int. Cl.[4] ..... E05D 15/06

[52] U.S. Cl. ..... 49/214; 16/104; 16/106; 49/409; 49/411; 49/425

[58] Field of Search ..... 49/214, 409, 410, 411, 49/412, 425; 16/87 R, 104, 106, 107, 89

[56] References Cited

U.S. PATENT DOCUMENTS

| | | | |
|---|---|---|---|
| 1,712,562 | 5/1929 | Jeffers | 49/214 |
| 2,322,529 | 6/1943 | Long | 49/409 X |
| 3,042,960 | 7/1962 | Spork | 16/89 X |
| 3,110,935 | 11/1963 | Riegelman | 49/411 |
| 3,879,799 | 4/1975 | Williams | 16/104 X |
| 4,141,106 | 2/1979 | Dixon | 16/104 X |
| 4,401,033 | 8/1983 | Gerken | 49/409 X |

FOREIGN PATENT DOCUMENTS

| | | | |
|---|---|---|---|
| 3201874 | 8/1983 | Fed. Rep. of Germany . | |
| 1244148 | 9/1960 | France . | |
| 2228143 | 11/1974 | France . | |
| 1477843 | 6/1977 | United Kingdom | 49/214 |

*Primary Examiner*—Philip C. Kannan

*Attorney, Agent, or Firm*—Young & Thompson

[57] ABSTRACT

A device for suspending and guiding an oblique-displacement sliding door, especially for railroad cars, comprises a rolling element which is attached to the door by means of a connecting member (4) and comprises two rollers (Gs, Gi) mounted within a tubular guide track (6). The rolling surfaces (6*a*, 6*b*, 6*c*, 6*d*) *of the guide track* (6) are located in oppositely-facing relation on each side of the connecting member (4) and at an oblique angle with respect to this latter. The profiles of the two rolling surfaces and of the two rollers are adapted to each other so as to prevent translational displacement of the rolling element (2) in a plane transverse to the guide track (6).

10 Claims, 6 Drawing Figures

DEVICE FOR SUSPENDING AND GUIDING A MOVABLE PANEL, IN PARTICULAR FOR AN OBLIQUE-DISPLACEMENT SLIDING DOOR

BACKGROUND OF THE INVENTION

1. Field of the Invention

The present invention relates to a device for suspending and guiding a movable panel or a similar load, especially for an oblique-displacement sliding door of the type employed in railroad cars. This invention is also directed to an oblique-displacement sliding door equipped with a device of this type.

2. Description of the Prior Art

The disadvantage of sliding doors lies in the fact that, in order to provide a tight seal at the time of closing, each door-edge face must come into contact with a surface which is perpendicular to the plane of closure. The external surfaces of the volume to be closed are therefore displaced to an extent corresponding to the thickness of the door. While this drawback is negligible in the case of interior doors such as cupboard doors, it becomes objectionable in the case of vehicles having doors of greater thickness which are required to provide an effective fluid-tight seal. Furthermore, variations in the external surface of the vehicle must be reduced to a minimum.

A known type of door accordingly undergoes a rectilinear longitudinal movement of translation during the main displacement of the door either for providing free access or for closing the opening and then, at the end of the closing movement of travel, undergoes an oblique movement of translation such that the door comes into position in the line of extension of the external surface of the volume to be closed. Doors of this type are designated as "oblique-displacement sliding doors". Once the door is closed, the external surface of the closed volume such as a vehicle has satisfactory continuity.

In the following description, the meaning of the term "translation" will be retained in its mathematical sense, in which a segment which joins two points of the panel remains parallel to itself and the vector representing the displacement of the panel has a direction either parallel to the plane of this latter or oriented transversely with respect to said plane.

Known devices which permit this double movement of longitudinal rectilinear translation followed by a transverse movement of translation are usually composed of rolling elements which run on one or a number of straight rails secured to the movable load by means of one or a number of bayonet-type double-elbowed shafts which undergo a movement of pivotal displacement at the end of the closing path of travel so that the door accordingly undergoes a curved movement of translation. The shaft or shafts pivot through an angle such that the door comes into position in the line of extension of the external surface of the volume to be protected.

Devices of this type must necessarily be provided with springs in order to ensure that the double-elbowed shafts open the door to the maximum extent during the rectilinear movement of translation and that this movement takes place in a predetermined and non-random manner. These springs must have a certain degree of stiffness, with the result that the user has to exert a greater effort in order to overcome the pressure of these springs during the final stage of closing in a curved movement of translation. While devices of this type may prove suitable in the event that the door is actuated by a jack, this is hardly the case if the door is actuated by an operator who has only moderate or low strength. In the case of heavier doors such as those of public transportation vehicles, the assistance of a jack is essential.

Suspension and guiding devices comprising conventional rolling elements such as rollers or wheels in cooperating relation with one or a number of rails which are partly rectilinear and partly curved are suitable for complex and costly uses such as industrial handling operations but cannot be contemplated for a vehicle door on account of their complexity and high cost. Furthermore, these devices require periodic maintenance and lubrication which impose additional demands on the user.

Another known type of suspension and guiding device comprises two rollers mounted on a common shaft and adapted to cooperate with two opposite rolling surfaces, with the result that the rollers rotate in opposite directions with respect to each other, these devices being primarily intended to support and guide French windows, sliding screens or anti-insect netting frames which are so arranged as to permit easy installation and removal. While devices of this type permit good suspension at the time of rectilinear translational motion, they offer only a very limited possibility of guiding which provides only for lateral reactions in one direction. These devices do not permit the construction of an oblique-displacement sliding door for vehicles.

For example, a guiding device is known in which a single roller runs on one side on a flange and a cylindrical roller runs on a flat surface, these two rollers being mounted on the same shaft which is attached to the load. This known device is intended to permit very rapid demounting of the door. Furthermore, a horizontal tractive force exerted at the level of the rolling element makes it possible to move the cylindrical roller away from the flat surface by sliding the single roller along the flange. This clearly shows that a device of this type is not suited for a vehicle door and that the guiding device could not follow sharp curves which would be liable to cause detachment of the cylindrical roller from the flat surface.

Furthermore, no provision has been made for any oblique displacement. Finally, an upward thrust exerted on the panel, as occurs at the time of a jolt of the vehicle, has the effect of detaching the assembly formed by the two rollers hereinabove described, thus disengaging the rolling element from the guide track, which is not suitable in the case of a vehicle door.

SUMMARY OF THE INVENTION

The aim of the present invention is to overcome the disadvantages mentioned in the foregoing by producing a device for suspending and guiding a movable panel, in particular for an oblique-displacement sliding door, in which said device does not make it possible in any event to cause detachment of the rollers with respect to the guide track, thus requiring no particular effort at the time of final rotational movement of translation of the door while at the same time offering minimal complexity and maintenance as well as low cost.

In accordance with the invention, the device for suspending and guiding a movable panel or a similar load, especially for an oblique-displacement sliding door comprising at least one rolling element attached to the movable panel and comprising two rollers in cooperating relation with two rolling surfaces of a tubular guide track which can have rectilinear portions and curved portions, is distinguished by the fact that the two rolling surfaces of the guide track are located in oppositely-facing relation on each side of the connecting member and at an oblique angle with respect to this latter, the profiles of the two rolling surfaces and of the two rollers being adapted to each other in order to prevent displacement of the rolling element in a plane transverse to the tubular guide track.

The arrangement of the oppositely-facing rolling surfaces maintains the two rollers in contact with the guide track even at the time of movements of translation along the curved portions of said guide track in either one direction or the other.

In an advantageous arrangement of the invention, the contact between the rollers and their rolling surface is substantially restricted to a point.

This arrangement is made possible by a judicious choice of materials for the surface of the rollers and has the effect of reducing frictional contacts of the entire assembly.

In an advantageous embodiment of the invention, the rolling surfaces of the guide track and the rollers have different but closely related radii of curvature in the vicinity of their contact zone.

An arrangement of this type postulates that a small displacement of the contact point between the roller and the rolling surface produces the fastest possible variation in the orientation of the force applied by the roller on the rolling surface. Thus the transverse stiffness of the assembly consisting of roller and rolling surface is of maximum value and the displacements of the panel in a direction transverse to the guide track will be reduced to a minimum when transverse stresses such as those induced by vertical jolts of a vehicle equipped with a device in accordance with the invention are applied to the door panel.

In an advantageous embodiment of the invention, the rollers have a convex profile and the rolling surfaces have concave profiles.

This makes it possible to provide a tubular guide track having a cross-section comprising the least possible variation of orientation and the concave profiles of the two rolling surfaces can be somewhat similar to the circular tubular shape. The rollers also have a conventional convex shape which is more economical to produce.

It is advantageously ensured that the roller shafts of the rolling element are parallel. In the first place, this makes it easier to mount the rollers on the member which provides a connection with the movable panel. In the second place, this arrangement provides a guide track having an internal shape which is more simple and more economical to produce.

BRIEF DESCRIPTION OF THE DRAWINGS

Other features of the invention will be more apparent upon consideration of the following description and accompanying drawings, wherein.

DESCRIPTION OF THE PREFERRED EMBODIMENTS

Figure 1:
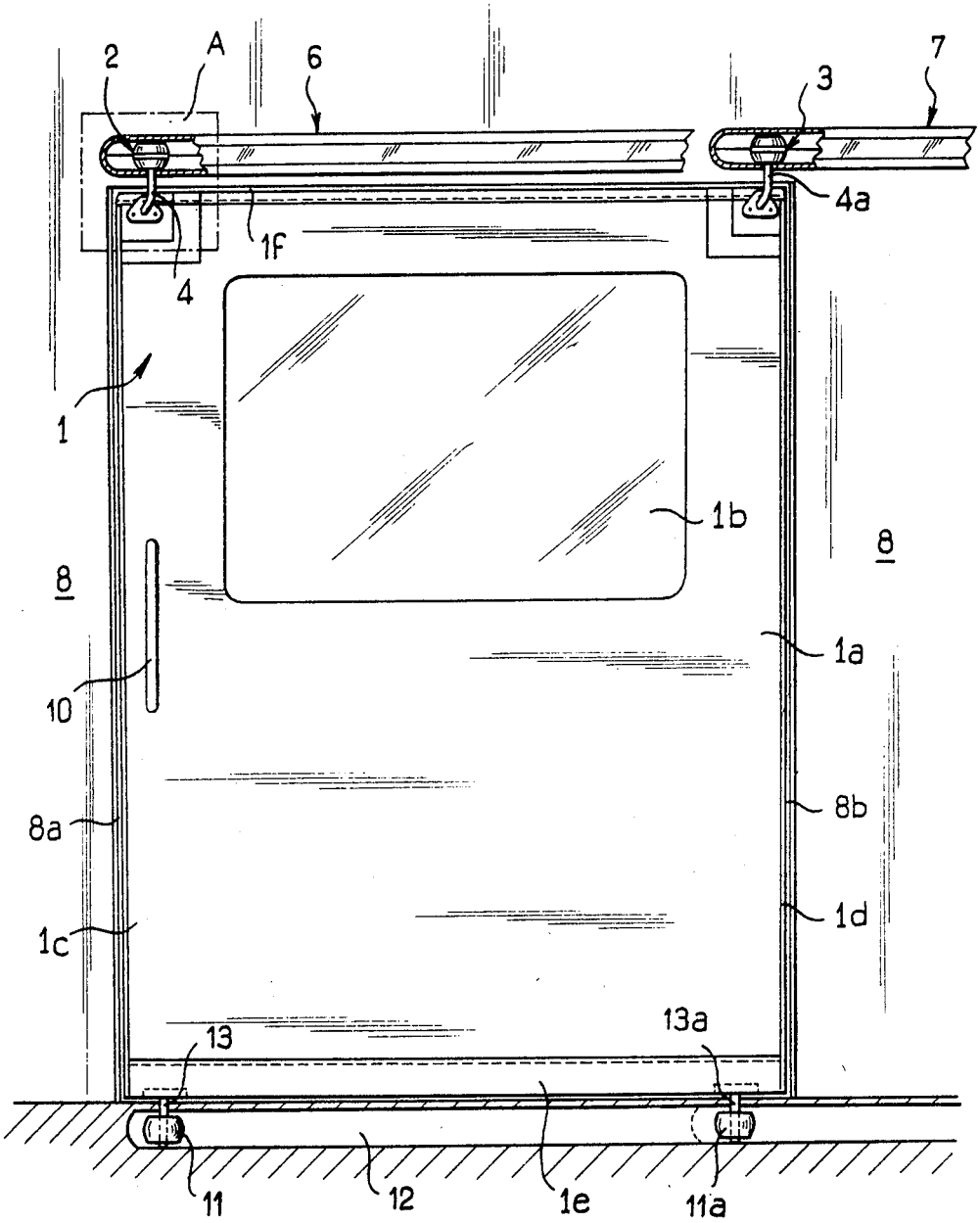
FIG. 1 is a view in elevation showing an oblique-displacement sliding door together with broken-off portions of its suspension and guiding device.
Figure 5:
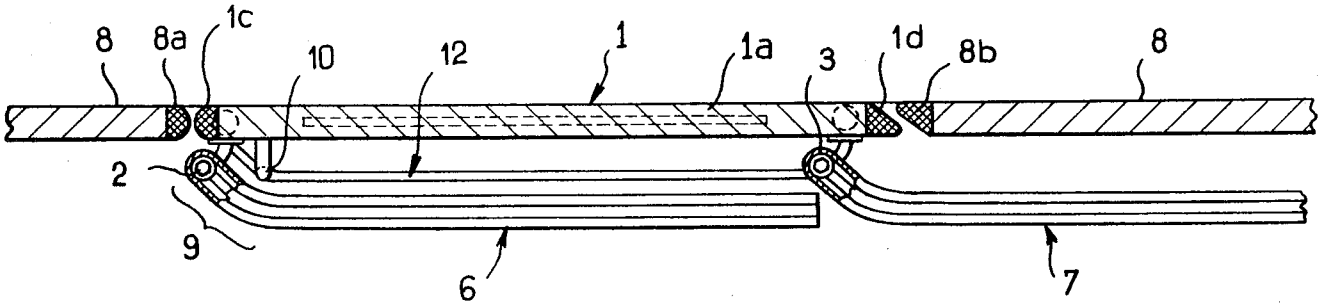
FIG. 5 is a top view of the door shown in FIG. 1.

FIGS. 1 and 5 illustrate a sliding door 1 in the closed position, of the type employed for equipping railroad cars. Said door 1 is composed of a metal panel 1*a* pierced by a glass window 1*b* and fitted with a handle 10. The edges of the panel 1*a* comprise rubber seals 1*c*, 1*d*, 1*e*, 1*f* applied against the edges of the opening 8 formed in the vertical wall of the car. The vertical edges of said opening 8 also comprise rubber seals 8*a*, 8*b*.

The door 1 is provided with two identical suspension and guiding devices comprising two rolling elements 2, 3 secured by means of connecting members 4, 4*a* to the top portion of the door. Said door further comprises two identical bottom guiding accessories 11, 11*a* secured to the bottom portion of the door by means of bottom connecting members 13, 13*a*.

Each rolling element 2, 3 is engaged within a tubular guide track 6, 7 which is attached to the side wall of the vehicle. These guide tracks are rectilinear over the greater part of their length and each have an elbow 9 near one end.

Figure 2:
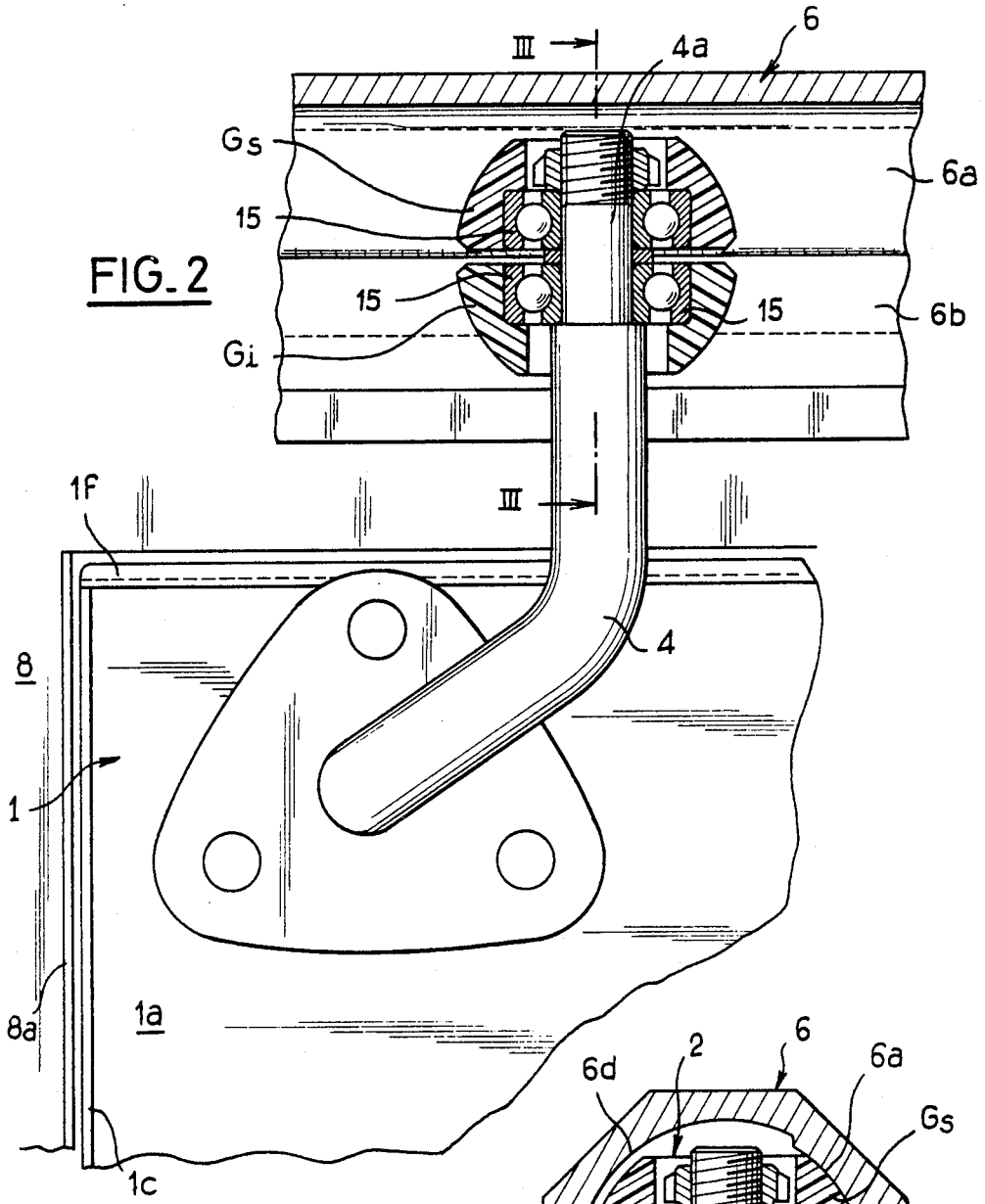
FIG. 2 is an enlarged view of the detail A of of FIG. 1.
Figure 3:
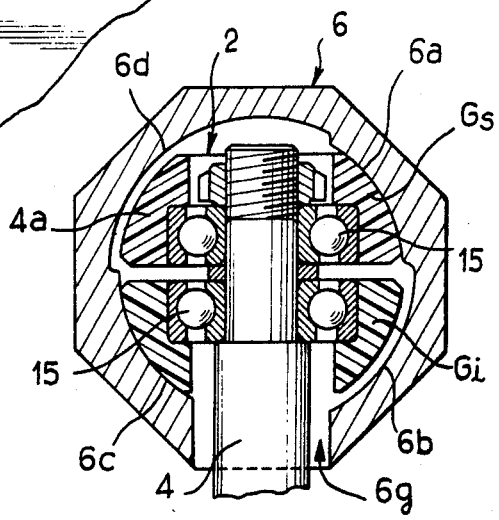
FIG. 3 is a sectional view taken along the plane III—III of FIG. 2.
Figure 4:
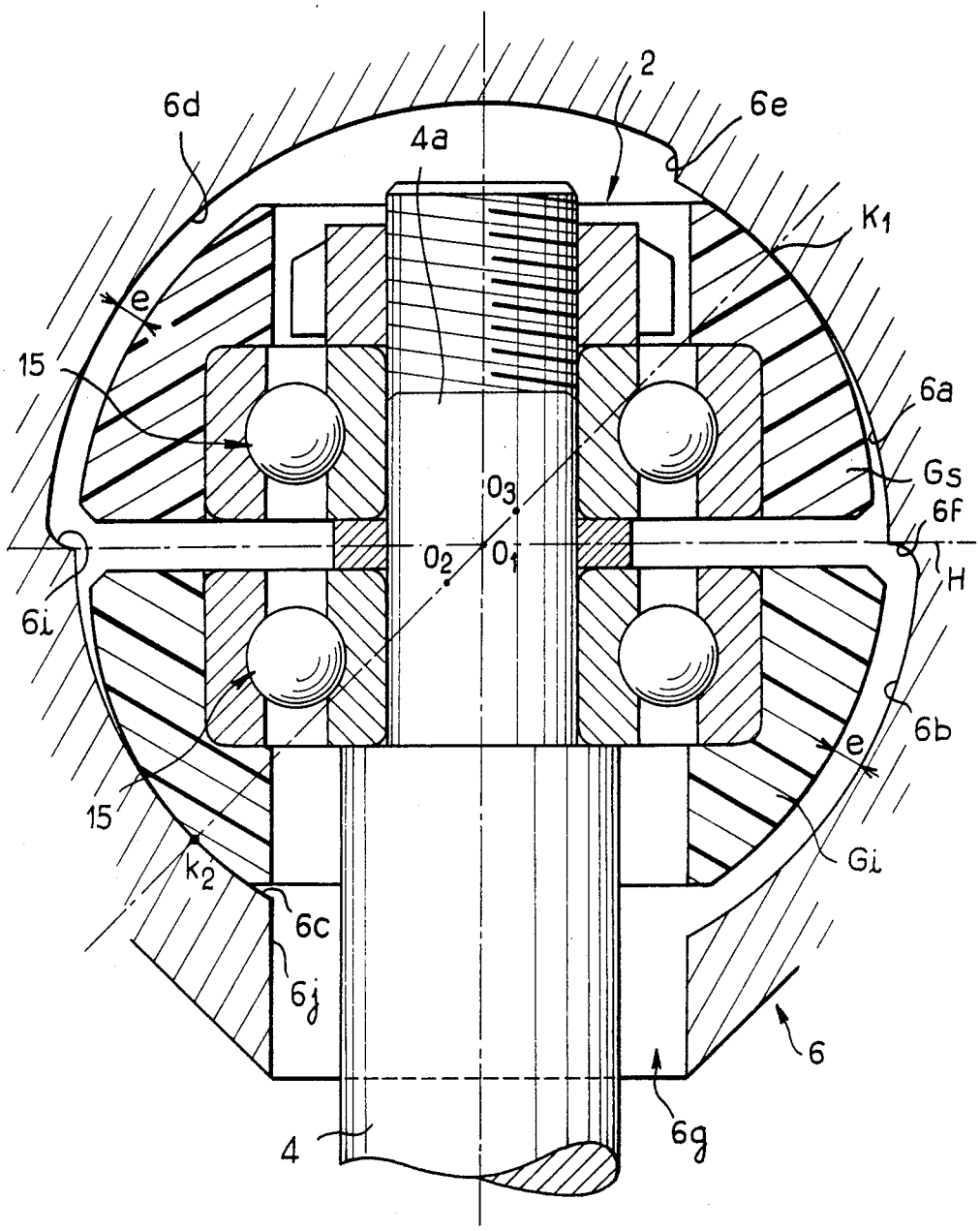
FIG. 4 is a view which is similar to that of FIG. 3 but to a larger scale.

FIGS. 2, 3 and 4 are detail views of the rolling element 2.

Said rolling element 2 comprises two rollers, namely a top roller Gs and a bottom roller Gi which are substantially symmetrical with respect to a horizontal plane (it is assumed that the railroad car is placed on a horizontal plane). Each roller is mounted on a ball-bearing 15 force-fitted on the shaft 4*a* constituted by the end of the connecting member 4. Said rollers (Gs, Gi) each have substantially the shape of a hollowed-out sphere frustum having the same radius and the same center, the hollowed-out portion of which is fixed on the outer ring of each ball-bearing 15. As will hereinafter be described in detail, said rollers (Gs, Gi) are adapted to cooperate with two guide tracks provided within a tubular guide track 6. Said rollers are preferably of polyacetal which is a high-strength resin marketed under the trade name Delrin.

The bottom guide accessory 11 (shown in FIG. 1) comprises a roller 11*a* rotatably mounted on a substantially vertical shaft 13 attached to the bottom portion of the door, said roller being adapted to cooperate with two guiding surfaces of a bottom guide track 12.

As indicated in FIGS. 3 and 4, the tubular guide track 6 has a slot 6*g* in which is engaged the intermediate portion of the connecting member 4 and has four internal rolling surfaces 6*a*, 6*b*, 6*c*, 6*d* for the rollers Gs and Gi, the cross-section of which is constituted substantially by four portions of a circle. In the enlarged view of Fig. 4, there is shown the common center $O_1$ of the substantially frusto-spherical surfaces of the rollers Gs and Gi. It can be seen that the top roller Gs is in contact at a point K1 with the internal surface 6*a* of the guide track 6.

For the sake of clarity of the following description, the expression "point of contact" between the spherical roller and the roller track will be retained although it actually refers to an elliptical contact zone, the dimensions of which are smaller as the materials in contact have a higher degree of hardness.

Similarly, the bottom roller Gi is in contact at a point K2 with the internal surface 6c of the guide track 6.

The cross-section of the guide tracks 6a, 6c has substantially the shape of a circular arc having a center $O_2$ and $O_3$ respectively. The straight line which joins these centers $O_2$, $O_3$ is inclined at an angle within the range of 20° to 40° with respect to a horizontal plane. These circular arcs represent an angular sector having an angle of less than 90° and have the same radius.

The guide track 6 has two other surfaces 6b and 6d located between the two surfaces 6a and 6c which are not in contact with the rollers Gs and Gi and form with these latter a clearance space e of a few tenths of a millimeter.

The rolling surface 6a of the top roller Gs and the rolling surface 6c of the bottom roller Gi are diametrically opposite with respect to the center $O_1$ and are angularly displaced with respect to a horizontal plane H (as shown in FIG. 4). These surfaces are formed on longitudinal bosses projecting from the internal cylindrical surface of the roller track 6 which forms the two other rolling surfaces 6b and 6d. The two bosses or surfaces 6a, 6c are delimited by ridges 6e, 6f; 6i, 6j respectively.

The operation of the device described in the foregoing will now be explained.

Figure 6:
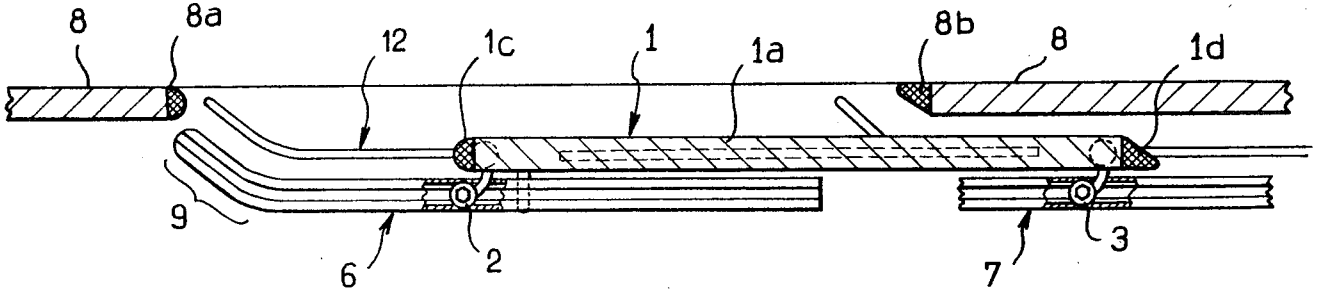
FIG. 6 is a view which is similar to FIG. 5 and in which the door is partly open.

When the door 1 is moved from the closed position (shown in FIG. 5) to the open position (shown in FIG. 6) and conversely, the top roller Gs runs on the surface 6a along a line of contact which passes through the point $K_1$ (see FIG. 4). Similarly, the bottom roller Gi runs on the surface 6c along a line of contact $K_2$. Since these two lines of contact are diametrically opposite and angularly displaced with respect to the horizontal plane H, any play of the rollers Gi and Gs in the roller track is thus avoided. Furthermore, by reason of the fact that the contact of the rollers with the rolling surfaces is reduced to one line for each roller and that the rollers in rotational motion are not in frictional contact with the surfaces which are symmetrical with respect to their axes, friction forces are limited to extremely low values.

Opening and closing of the door 1 thus takes place without effort and without noise.

As will readily be apparent, the invention is not limited to the example described in the foregoing and any number of modifications may accordingly be contemplated without thereby departing either from the scope or the spirit of the invention.

Thus the rollers Gs and Gi need not have the shape of a sphere frustum. The essential points are that the roller track should comprise two rollers, that the rolling surfaces of these rollers should be placed on each side of the connecting member 4 at an oblique angle with respect to this latter and directed towards each other, and that said surfaces should be adapted to those of the rollers in order to prevent any translational movement of the rolling element 2 in a plane transverse to the tubular guide track.

What is claimed is:

1. A device for suspending and guiding a movable panel (1a) or a similar load, especially for an oblique-displacement sliding door (1) comprising at least one rolling element (2, 3) attached to the movable panel by means of a connecting member (4, 4a), the rolling element comprising two rollers (Gs, Gi) in cooperating relation with rolling surfaces (6a, 6b, 6c, 6d) of a tubular guide track (6, 7) which can have rectilinear portions and curved portions, wherein the rolling surfaces (6a, 6b, 6c, 6d) of the guide track (6, 7) are located in oppositely-facing relation on each side of the connecting member (4, 4a) at an oblique angle with respect to said member, the profiles of the two rolling surfaces and of the two rollers (Gs, Gi) being adapted to each other in order to prevent a movement of translation of the rolling element in a plane transverse to said tubular guide track.

2. A suspension and guiding device according to claim 1, wherein the contact between the rollers (Gs, Gi) and their rolling surface (6a, 6b, 6c, 6d) is substantially restricted to a point.

3. A suspension and guiding device according to claim 2, wherein the rolling surfaces (6a, 6b, 6c, 6d) and the rollers (Gs, Gi) have different but closely related radii of curvature in the vicinity of their contact zone.

4. A suspension and guiding device according to claim 3, wherein the rollers (Gs, Gi) have convex profiles and the rolling surfaces (6a, 6b, 6c, 6d) have concave profiles.

5. A suspension and guiding device according to claim 4, wherein the two rollers (Gs, Gi) are rotatably mounted on a common shaft.

6. A device according to claim 5, wherein the two rollers (Gs, Gi) have a frusto-spherical shape, have the same radius and are centered on a common axis.

7. A device according to claim 6, wherein the two rollers (Gs, Gi) have the same center ($O_1$).

8. A device according to claim 7, wherein at least the external portion of the rollers (Gs, Gi) which is intended to cooperate with the rolling surfaces (6a, 6b, 6c, 6d) is of polyacetal resin.

9. A device according to claim 8, wherein the rolling surfaces (6a, 6b, 6c, 6d) have a profile substantially in the shape of a circular section of slightly longer radius than the rollers (Gs, Gi).

10. A device according to claim 9, wherein the tubular guide track (6) has a cylindrical internal surface on which are formed two longitudinal bosses each adapted to carry one (6a, 6c) of the two rolling surfaces, the guide track being also provided with a longitudinal slot (6g) in which is engaged the member (4) providing a connection with the panel (1a).

* * * * *